United States Patent [19]

Kitai et al.

[11] 4,272,839

[45] Jun. 9, 1981

[54] ELECTRIC TIMER

[75] Inventors: Kiyoshi Kitai; Nobuo Shinozaki, both of Yotsukaido, Japan

[73] Assignee: Seiko Koki Kabushiki Kaisha, Tokyo, Japan

[21] Appl. No.: 18,913

[22] Filed: Mar. 9, 1979

[30] Foreign Application Priority Data

Mar. 10, 1978 [JP] Japan ..... 53-28129

[51] Int. Cl.[3] ..... G04F 8/00; G04B 15/00

[52] U.S. Cl. ..... 368/107; 368/126

[58] Field of Search ..... 58/22.9, 33, 21.13, 58/39.5, 85.5, 74, 141–142, 28 A, 28 B, 28 D, 116 M, 145 R; 200/35 R, 38 R, 35 H, 38 B

[56] References Cited

U.S. PATENT DOCUMENTS

| | | | |
|---|---|---|---|
| 1,514,751 | 11/1924 | Wold | 58/23 X |
| 2,212,319 | 8/1940 | Gerots | 58/22.9 X |
| 2,426,801 | 9/1947 | Vannini | 58/26 X |
| 2,488,754 | 11/1949 | Willson | 200/35 R X |
| 2,565,017 | 8/1951 | Brown | 58/21.13 |
| 2,900,021 | 8/1959 | Richtmyer et al. | 200/35 R X |
| 3,188,504 | 6/1965 | Anderson | 200/38 B X |

*Primary Examiner*—Vit W. Miska

*Attorney, Agent, or Firm*—Robert E. Burns; Emmanuel J. Lobato; Bruce L. Adams

[57] ABSTRACT

An electric timer includes a rotatably mounted operating member which is movable from a datum position to any one of a plurality of angular positions which correspond to periods of time for which it is desired to set the time period. The operating member is urged to rotate in the direction towards the datum position when it is set to a desired angular position. A rotatably mounted toothed member is driven by the operating member when the operating member is urged back towards the datum position. A pivotable escapement member engages with the teeth of the toothed member, and an electro-magnet controls the pivoting of the escapement member and thereby the rotation of the toothed member and operating member. The electro-magnet comprises a permanent magnet for exerting a magnetic force to normally attract the escapement member, and a winding receptive of reference pulses to reduce the magnetic force exerted by the permanent magnet so as to permit the pivoting of the escapement member.

5 Claims, 6 Drawing Figures

ELECTRIC TIMER

BACKGROUND OF THE INVENTION

This invention relates to an electric timer which may be set to display the operational times of the timer.

Conventional electric timers in which the switch for the electric equipment, etc., to be associated with the timer is operated or an alarm is generated by a buzzer stored in the timer, may be classified into the mechanical type in which an electric motor is applied as a driving source and the electronic type having a signal generator and a frequency divider circuit etc. The former poses a difficult problem of miniaturization due to having an electric motor therein and has a high current consumption, further has a short battery life in the case of the power supply comprising a battery and the later has no means for displaying the remaining period of time for the predetermined operational time during the operation of the timer and the switch. On the other hand, even in a mechanical timer having a clock movement such as anchor or star wheel having the driving force of a spring, the structure is complicated and the accuracy in the operational time of the timer is poor.

SUMMARY OF THE INVENTION

Thus, it is an object of the present invention to provide an electric timer having none of the defects described above. In accordance with the present invention, the engagement member in cooperation with the operating member normally biased in one direction in relation with means for setting and displaying the operational time of the timer is restricted by the electromagnet operated by the output signals from the signal generator and the driving circuit.

DETAILED DESCRIPTION OF THE PREFERRED EMBODIMENTS

Figure 1:
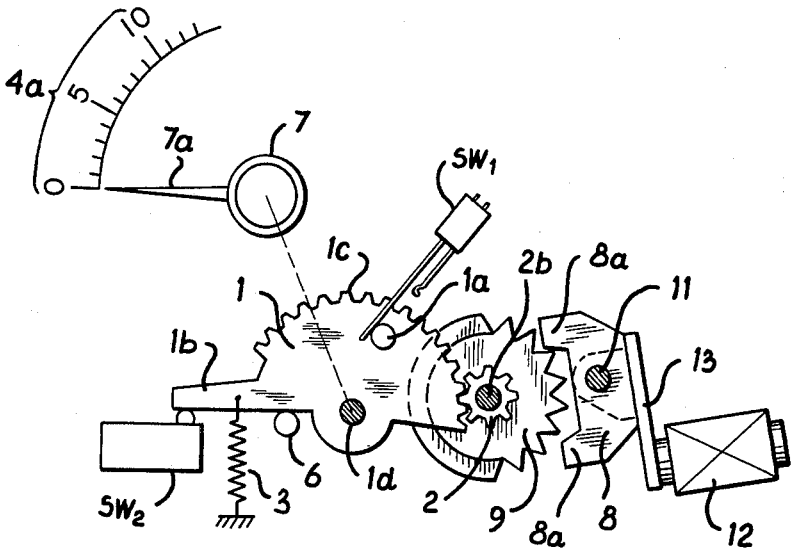
FIG. 1 is a top plan view of one embodiment of the present invention.

Referring now to the drawings, the preferred embodiments of the present invention will be described hereinbelow.

At first, a structure of the first embodiment of the present invention illustrated in FIGS. 1 to 4 will be described. An operating member 1 which may be operated by the operation of the timer is formed integral with an operating pin 1*a* for opening and closing a power supply switch $SW_1$ for a timer electric circuit, an arm 1*b* for operating a microswitch $SW_2$ to be connected with the associated electric equipment, etc., a gear sector 1*c* engaged with a ratchet pinion 2 described later so as to transmit the rotational movement thereof and a shaft 1*d*. The operating member 1 is rotatably supported by the shaft 1*d*, upper plate 4 and lower plate 5. The operating member 1 is also biased in a counter-clockwise direction by urging means in the form of a spring 3 and at the same time its pivotal movement is restricted by a stopper 6. The shaft 1*d* passes through a supporting hole in the upper plate 4 and has a knob 7 at the leading end thereof. The knob 7 is provided with a pointer 7*a* for use in setting or displaying the timer operation time and the pointer cooperates with a scale 4*a* arranged on the upper plate 4. The operating member 1 is arranged such that, under the condition in which the biasing force in a counter-clockwise direction is restricted by the stopper 6, the power supply switch $SW_1$ is set OFF, the microswitch $SW_2$ is set ON or OFF and the pointer 7*a* of the knob is positioned at 0 on the scale 4*a*. The pinion 2, in cooperation with the operating member 1, is connected such that pinion part 2*a* is engaged with the gear sector 1*c* and the shaft part 2*b* rotatably supporting a toothed star wheel 9 having a plurality of teeth are integrally formed with each other, the star wheel 9 transmits the rotation of the pinion 2 due to a desired friction force caused by a leaf spring 10 against the star wheel 9. The ratchet pinion 2 is rotatably supported by the shaft 2*b*, upper plate 4 and the lower plate 5. An escapement or engagement member 8 has two claws 8*a* engageable with the star wheel 9. The engagement member 8 is fixed to the shaft 11 and pivotally supported by shaft 11 and the upper and lower plates 4 and 5. To the engagement member 8 is fixed a magnetic piece 13 composed of a magnetic material so as to be attracted by energization of the electro-magnet 12. Engagement relation between the toothed star wheel 9 and the engagement member 8 is made such that when either one of the two claws 8*a* of the engagement member 8 is out of the rotational orbit of the leading end of the teeth of the star wheel 9, the other is in the rotational orbit of the teeth and, the engagement member 8 is pivotally rotated in response to a rotation corresponding to one tooth of the star wheel 9, this pivotal movement causing the magnetic piece 13 to be pressed against or moved toward the electro-magnet 12. Under a deenergized condition of the electro-magnet 12, the star wheel 9 is not applied with any restriction of the engagement member 8 by the biasing force of the operating member 1, but rotated in a clockwise direction while the engagement member 8 is oscillated. To the contrary, under an energized condition of the electro-magnet 12, the star wheel 9 is prevented by the engagement member 8 from being rotated. A connecting force, by friction between the star wheel 9 and the pinion 2, is set by the leaf spring 10 such that when the timer is operated under such condition as the rotation of the star wheel 9 is restricted by the operation of the magnetic piece 13 and the engagement member 8 caused by the electro-magnet 12, the star wheel 9 and the pinion 2 are integrally operated and when the time setting of the timer and the operation of the timer are forcedly terminated, both of them undergo slippage relative to one another and are separately operated.

Figure 2:
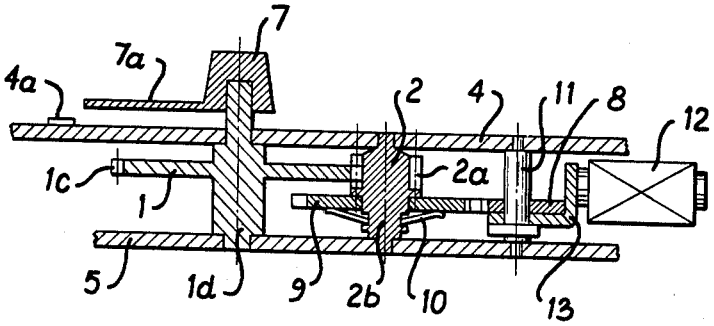
FIG. 2 is a sectional view of FIG. 1.
Figure 3:
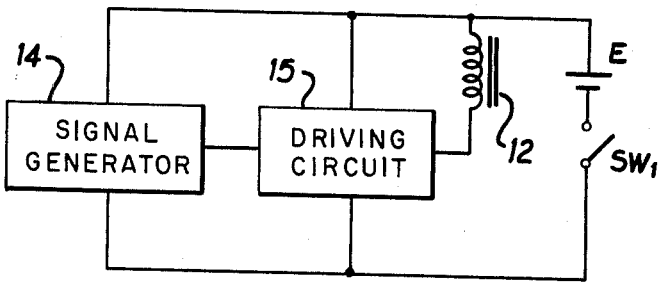
FIG. 3 is a block diagram of an electric circuit for use in operating the first embodiment.

FIG. 3 is a block diagram of an electric circuit for the timer shown in FIGS. 1 and 2. A signal generator 14 for producing a time reference pulse and a driving circuit 15 for operating the electro-magnet 12 in response to the output from the signal generator 14 are connected in parallel with a power supply E via power supply switch $SW_1$. To the driving circuit 15 is connected an output terminal of the signal generator 14 and to the output terminal of the driving circuit 15 is connected the electro-magnet 12.

Figure 4:
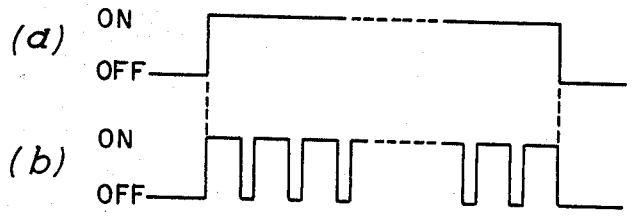
FIG. 4 is a timing chart for the electric circuit.

FIG. 4 is a timing chart for the electric circuit of FIG. 3 and (a) shows an operation of the power supply switch $SW_1$, and (b) shows the output signal from the driving circuit 15. The rectangular pulse signal is produced from the driving circuit 15 by turning on the power supply switch $SW_1$ and not produced when the power supply switch $SW_1$ is turned off.

Now the operation of the first embodiment of the above described arrangement will be described hereinbelow.

FIG. 1 shows a condition before the timer is set or after the operation is completed, the operating member 1 is restricted in its counter-clockwise rotation by the stopper 6, the power supply switch $SW_1$ is turned off by the operating pin 1*a*, the microswitch $SW_2$ is turned on or turned off by the operating arm 1*b*, the pointer 7*a* of the knob is set at the 0-position of the scale 4*a*, and the electric circuit is made inoperative by turning off the power supply switch $SW_1$.

In order to operate the timer starting from the above described condition, the knob 7 is rotated in a clockwise direction and the pointer 7*a* is set to any one mark of the scale 4*a* to get a desired operating time of the timer, then the power supply switch $SW_1$ is turned on by the operating member 1, the microswitch $SW_2$ is turned off or on. When the power supply switch $SW_1$ is turned on, the electro-magnet 12 is operated by the output signals of the signal generator 14 and the driving circuit 15. The biasing force of the operating member 1 will cause the star wheel 9 to be rotated in a clockwise direction via gear sector 1*c* of the operating member, pinion 2 and the leaf spring 10. However, the rotational movement of the star wheel is controlled by the electro-magnet 12, magnetic piece 13 and the engagement member 8. The output signal of the driving circuit 15 is a rectangular pulse signal having a predetermined frequency and one pulse signal will cause the electro-magnet 12 to be energized or deenergized. When the electro-magnet 12 is in an energized condition, the magnet attracts the magnetic piece 13 to prevent the oscillation of the engagement member 8 and then the star wheel 9 is prevented by the claw 8*a* of the engagement member against the clockwise rotation. When the electro-magnet 12 is in a deenergized condition, the magnetic piece 13 is not attracted thereto and the star wheel 9 is rotated in a clockwise direction while the engagement member 8 is oscillated. However, since the deenergization time of the electro-magnet 12 is long enough to rotate the star wheel 9 by an amount corresponding to one tooth, the engagement member 8 is restricted by the electro-magnet 12 via magnetic piece 13 every time the engagement member is rotated by one time unit, and rotates the star wheel 9 in a stepwise manner in relation to the period of the pulse signal. Thus, the rotational angle of the operating member 1 in cooperation with the star wheel 9 is determined by the period of the pulse signal, the number of teeth of the star wheel 9 and the transmission ratio between the ratchet pinion 2 and the operating member 1. Further, since the relation between the operating member 1, pointer 7*a* of the knob on the shaft of the operating member and the scale 4*a* has been determined, the pointer 7*a* and the scale 4*a* will be used to display the operation of the timer and the remaining operational time up to a predetermined operational time of the microswitch $SW_2$.

After the predetermined operational time of the timer is passed, the operating member 1 operates the power supply switch $SW_1$ and the micro switch $SW_2$ to produce a condition shown in FIG. 1 and the operation is terminated.

In the midway of the operation of the timer, when it is desired to change the setting time or forcably terminate the operation, the operation of the knob 7 will cause a slippage between the pinion 2 and the star wheel 9, and thus the changing or terminating the operation may easily be performed.

Figure 5:
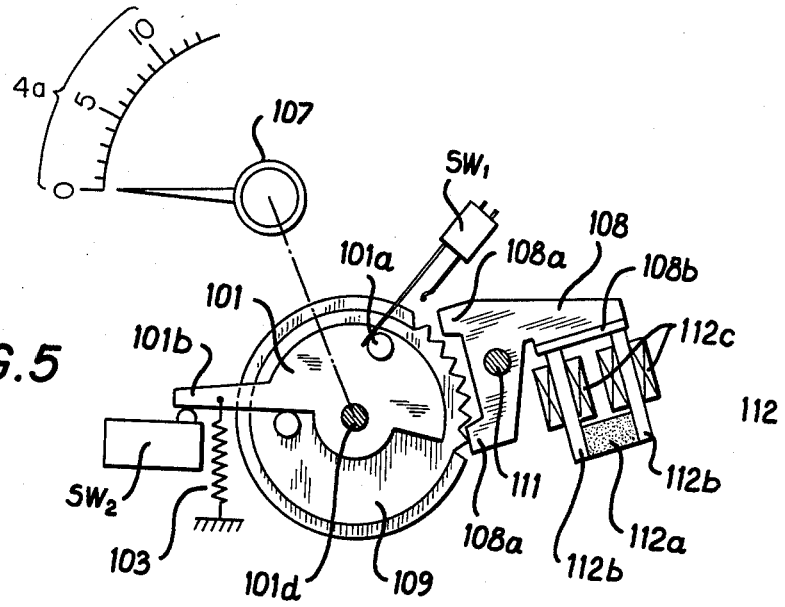
FIG. 5 is a top plan view of a second embodiment of the present invention.
Figure 6:
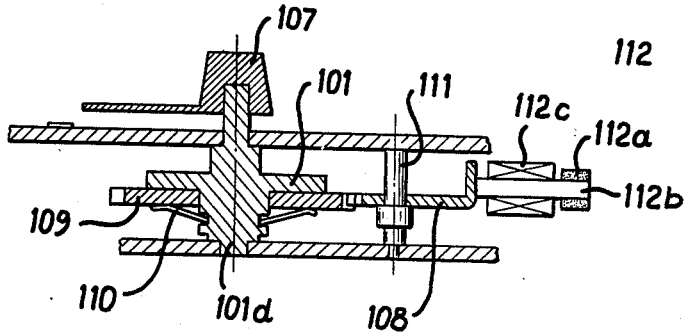
FIG. 6 is a sectional view of FIG. 5.

In FIGS. 5 and 6 is illustrated a second embodiment of the present invention, in which the operating member 101 is biased in a counter-clockwise direction by urging means comprising a spring 103. The operating member has an operating pin 101*a* for opening and closing the power supply switch $SW_1$ and an operating arm 101*b* for opening and closing the micro-switch $SW_2$. The operating member is rotatably supported by a shaft 101*d* and at the leading end of which is mounted a knob 107. A star wheel 109 is set on the shaft 101*d* such that a desired slip torque may be maintained against the operating member 101 by a leaf spring 110 and the star wheel may be rotated. An escapement or engagement member 108 has two claws 108*a* to be engaged with the star wheel 109, and has a retraction part 108*b* composed of a magnetic material and having a relation with the electro-magnet 112. The engagement member 108 is fixed to the axis 111 and pivotally supported thereby. The electro-magnet 112 has a permanent magnet 112*a* having two polarities, two iron cores 112*b* having some relation with the polarity of the permanent magnet 112*a*, and two windings 112*c* configured to be energized in such direction that the magnetic force of said permanent magnet 112*a* is reduced when the output signal of the driving circuit is used to energize the power supply. The cooperative relation between the star wheel 109, engagement member 108 and the electro-magnet 112, etc., is the same as that of the first embodiment. The electric circuit for use in operating the second embodiment is different from that of the first embodiment only in the ratio between the ON-OFF times of the pulse signal for use in operating the electro-magnet 112.

Referring now to FIGS. 5 and 6, the operation of the second embodiment of the above described construction will be described.

FIG. 5 shows a condition before the timer is set and after the operation is finished. The power supply switch $SW_1$ is turned off by the operating member 101, the microswitch $SW_2$ is turned on or off, and the magnetic retraction part 108*b* of the engagement member is kept in the retracted condition against the iron cores 112*b* by the permanent magnet 112*a* of the electro-magnet. When the knob 107 is rotated in a clockwise direction in order to operate the timer in reference to the above described condition, the star wheel 109 is prevented from being rotated by the engagement member 108 being retracted against the electro-magnet 112. Thus, the operating member 101 is rotated to such position as the desired operating time of the timer is made while the frictional engagement between the operating member 101 and the star wheel 109 is slipped. When the power supply switch $SW_1$ is turned on by this operation and the electro-magnet 112 is operated by the output signal of the driving circuit, the star wheel 109 starts to rotate integrally in a counter-clockwise direction along with the operating member 101 while being controlled by the engagement member 108. The time in which the winding 112*c* of the electro-magnet is energized by the output signal of the driving circuit has been set so as to be required to rotate by an amount corresponding to one tooth of the star wheel 109. When the winding 112*c* of the electro-magnet is energized by one pulse signal, winding 112c is energized and when the magnetic force of the permanent magnet 112a is decreased, the engagement member 108 is oscillated due to relief from the influence of the electro-magnet 112, thereby the star wheel 109 is rotated in a counter-clockwise direction by an amount corresponding to one tooth. After a rotation corresponding to one tooth, the retraction part 108b of the engagement member is attracted against the iron core 112b by the permanent magnet 112a and the pivotal movement of the star wheel 109 is prevented by the claw 108a of the engagement member. The operating member 101 is integrally rotated in a counter-clockwise direction as the star wheel 109 is rotated in a step-wise manner, and after the predetermined operating time of the timer, the power supply switch $SW_1$ and the micro switch $SW_2$ are operated to produce a condition shown in FIG. 5 and then the operation is terminated.

In the embodiments of the present invention, the magnetic piece 13 or the retraction part 108b and the engagement members 8 and 108 are closely contacted with each other when oscillated or rotated and this enables a small-sized structure by the electro-magnet having less power consumption and at the same time in case of the second embodiment, it is possible to set a short energization time and thus it is possible to save power consumption.

As described above, in accordance with the present invention, the setting or display of the operating time of the timer is performed mechanically and the control over the operating time is conducted electronically and thereby it is possible not only to eliminate the disadvantages of the conventional mechanical or electrical timer devices but also to have a thirty-minute timer and a sixty-minute timer on the basis of a ten-minute timer by making the electric circuit in which the frequency of the pulse signal enabling the electro-magnet into three- or six-times. Further, it has such advantage as the structure is simple and economical in construction and at the same time it is possible to provide a small-sized timer device.

We claim:

1. An electric timer comprising: a rotatably mounted operating member movable from a datum position to any one of a plurality of angular positions respectively corresponding to periods of time for which it is desired to set the timer; means cooperative with the operating member for indicating the setting of the operating member to a desired angular position; means for urging the operating member to rotate in a predetermined direction from the desired angular position back to the datum position; a rotatably mounted toothed member having a plurality of teeth; means connecting the toothed member to the operating member when the operating member is rotated by the urging means; a pivotally mounted escapement member having a magnetic portion and being engageable with the teeth of the toothed member to control the rotation of the toothed member and thereby the operating member; a signal generator for producing time reference pulses; and electro-magnetic means including a permanent magnet disposed adjacent the magnetic portion of the escapement member for exerting a magnetic force to normally magnetically attract the escapement member, and at least one winding receptive of the time reference pulses and configued to reduce the magnetic force exerted by the permanent magnet when energized by the time reference pulses to permit the pivoting of the escapement member and thereby the rotation of the toothed member and the operating member under the action of the urging means.

2. An electric timer as claimed in claim 1, wherein each pulse effects energization and deenergization of the electro-magnet to rotate the toothed member through one tooth pitch for each pulse.

3. An electric timer as claimed in claim 1, further comprising a power supply switch coactive with the operating member to be closed when the operating member is moved away from the datum position and to be opened when the operating member returns to the datum position.

4. An electric timer as claimed in claim 1, further comprising a switch for controlling circuitry external to the timer and coactive with the operating member to change state when the operating member is moved out of the datum position and into the datum position.

5. An electric timer as claimed in claim 1, wherein the means operatively connecting the toothed member to the operating member comprises a friction coupling which permits the operating member to be slipped with respect to the toothed member.

* * * * *